United States Patent [19]

Murakami

[11] Patent Number: 4,769,797

[45] Date of Patent: Sep. 6, 1988

[54] STOP WATCH

[75] Inventor: Tomomi Murakami, Higashimurayama, Japan

[73] Assignee: Citizen Watch Co., Ltd., Tokyo, Japan

[21] Appl. No.: 121,872

[22] Filed: Nov. 17, 1987

[30] Foreign Application Priority Data

Nov. 18, 1986 [JP] Japan ..... 61-272776

[51] Int. Cl.[4] ..... G04F 8/00; G04C 17/00

[52] U.S. Cl. ..... 368/111; 368/69

[58] Field of Search ..... 368/69–70, 368/110–113, 185–188

[56] References Cited

U.S. PATENT DOCUMENTS 3,992,871 11/1976 Numabe ..... 368/112
4,078,376 3/1978 Freeman ..... 368/73
4,089,156 5/1978 Kashio ..... 368/112
4,110,966 9/1978 Kashio ..... 368/112
4,477,194 10/1984 Michel et al. ..... 368/69

FOREIGN PATENT DOCUMENTS 53-80263 7/1978 Japan .
62-39353 2/1986 Japan .

*Primary Examiner*—Vit W. Miska
*Attorney, Agent, or Firm*—Finnegan, Henderson, Farabow, Garrett & Dunner

[57] ABSTRACT

A watch, comprising a reference signal generator circuit, a stop watch circuit, an external operation switch, a display selection circuit, an elapsed time display timer, and an impact detecting circuit, wherein an elapsed time is displayed at a display element for a predetermined time, by utilizing an impact force, and the display of the elapsed time is fixed at the display means, and further, the elapsed time is memorized in a plurality of memories for later retrienal.

17 Claims, 12 Drawing Sheets

STOP WATCH

BACKGROUND OF THE INVENTION

1. Field of the Invention

This invention is related to a switch means for stopping an operation of a stop watch with an electronic circuit, and to a memory system for storing data of a measured elapsed time.

2. Description of the Related Art

In already known stop watches or electronic watches having a stop-watch function, a mechanical contact point system operated by a push button or a stem is provided for starting or stopping the movement of the stop watch.

Further, in, for example, large athletic meetings, the time measurement of a race is stopped when a runner passes a certain point at which a light interruption system or light reflection system using, for example, photo electronic sensors, is located.

Recent technological developments, however, have led to the use of a signal generated from a piezo electric element when loaded with an impact force, as an input signal of the stop watch.

Such a piezo electric element switch is disclosed, for example, in Japanese Unexamined Patent Publication No. 53-80263, in which an electronic circuit of the watch is operated by an impact signal generated by striking a piezo electric element fixed on a portion of the watch.

In, for example, a ski competition, there is a demand for a portable stop-watch with which the competitors in a race or ordinary skiers can obtain an elapsed time without using the solid type time measurement instrument afore mentioned, and thus the system of stopping the stop watch with an impact signal would be convenient. However in, for example, a ski competition, obviously such a stop watch often would be unavoidably subjected to an impact force during a normal ski-race, etc., and thus a stop watch as mentioned above would not be suitable for such activities.

On the other hand, the skier often wants to store a plurality of elapsed time data or the stop time data in the memory, to compare present times with past times.

Heretofore, in a stop watch function of an electronic watch available on the market, a plurality of memories are provided in the watch for memorizing measured time data and for retrieving this data whenever required after a measurement operation to obtain an intermediate elapsed time, for example, a lap time at 5 km intervals in a marathon race. But there must be some limitation to the capacity of the memory circuit, and therefore, in a watch having a system for stopping the watch with an impact force, an elapsed time measuring operation will be carried out every time an impact force is felt by a skier on the arm and, therefore, only the most important one of actual elapsed time is memorized in the memory Accordingly, a problem arises in that only one data in the exercises can be retrieved for a downhill ski run, for example, because during the ski run practice, a skier runs several times on the same downhill course and the data obtained at each run is to be evaluated with the other data obtained thereby.

In view of the above problems, the object of this invention is to provide a switch of a stop-watch to be used to measure the time accurately during a competition such as a ski or bicycle race, by which the users must carry out a relatively complicated operation to stop the watch.

Another object of this invention is to provide a stop watch having a function for memorizing a plurality of only the most important elapsed time data in a plurality of merories and for retrieving this data thereafter, and further having a function for memorizing the number of data input and moreover, having a function for displaying this data as, for example, the elapsed time in xx minutes and yy seconds at a certain number of times the data was obtained.

SUMMARY OF THE INVENTION

Therefore, according to this invention, there is provided, a stop watch having a reference signal generating circuit, a stop watch circuit for counting reference signals generated by the reference signal generating circuit and developing elapsed time data, an external operation switch circuit for controlling the operation of the stop watch circuit, a display means, an elapsed time display timer circuit for controlling the stop watch circuit and for selectively commanding the circuit either to display a measuring time in the stop watch circuit continuously at the display means or to fixedly display a certain elapsed time at the display means or to display that time for a predetermined time interval, and an impact detecting circuit for detecting an impact force loaded on an outer case of the watch and for developing an impact pulse signal by converting the impact force to an electrical signal.

In the stop watch according to this invention, the elapsed time data in the stop watch circuit, which is counting the reference signals, is displayed at the display means for a certain time interval by starting the operation of the elapsed time display timer circuit with an impact pulse signal generated by striking the outer case of the stop watch and the elapsed time is fixedly displayed at the display means as the final elapsed time regardless of the operation of the elapsed time display timer circuit by stopping a counting operation of the stop watch circuit by a stopping operation thereof with said external operation switch circuit while the elapsed time display timer is working.

This invention is described in more detail as follows.

The stop watch circuit mentioned above preferably consists of at least an elapsed time measuring circuit which measures a time elapsed from a starting time of the measurement with a reference signal from a reference signal generator circuit and a latch circuit which latches a data output therefrom. The stop watch circuit of this invention can display a current time counted from the start of the measuring time at the display means as in a normal watch, and can display a certain elapsed time which shows a certain time interval defined between the time when the measurement operation was started and the time when the stopping watch operation was effected under a control of the elapsed time display timer circuit.

Further, in the stop watch of this invention, all data counted by the elapsed time measuring circuit is simultaneously latched in the latch circuit, therefore the data latched in this circuit can be output at the display means. In another embodiment, a separate memory circuit also can be provided in addition to the latch circuit and data latched in the latch circuit can be displayed at the display means after once being stored in this memory circuit by the impact signal. Moreover, according to this invention, special memcry circuits for memorizing an elapsed time data displayed at the display means can be provided in addition to the circuits mentioned above, to attain the objects of this invention.

The embodiments of this invention are described with reference to the drawings, but the scope of this invention is not restricted to these embodiments.

BRIEF DESCRIPTION OF THE DRAWINGS

FIG. 13 is a schematic view of an inner system of a display switching circuit shown in FIG. 12 wherein FIG. 13B is a timing chart of the display switching circuit;

FIG. 14 is a block diagram of an inner portion of an external operation circuit block, wherein FIG. 14A is a block diagram thereof, and FIG. 14B is a timing chart thereof;

FIG. 15 shows a system of an elapsed time display timer circuit block wherein FIG. 15A is a system diagram thereof and FIG. 15B is a timing chart thereof;

DESCRIPTION OF THE PREFERRED EMBODIMENTS

According to a first embodiment of this invention, there is provided a stop watch having a reference signal generating circuit, a stop watch circuit for counting reference signals generated by the reference signal generating circuit and developing elapsed time data, an external operation switch circuit for controlling the operation of the stop watch circuit, an elapsed time memory circuit for memorizing the elapsed time data in the stop watch circuit, a display selection circuit for selecting either the data of the elapsed time memory circuit or the data of the stop watch circuit for display by a display means, an elapsed time display tmer for controlling the display selection circuit and retaining a display condition of the elapsed time for a predetermined time, an impact detecting circuit for detecting an impact force loaded on an outer case of the watch and for developing an impact pulse signal by converting the impact force to an electrical signal.

In the stop watch according to this invention, the elapsed time data in the stop watch circuit, which is counting the reference signals, is memorized in the elapsed time memory circuit by an impact pulse signal generated by striking the outer case of the stop watch, and simultaneously, the data is converted by the display selection circuit into an elapsed time display by starting the operation of the elapsed time display circuit.

Further, the counting of the stop watch circuit is stopped by using the external operation switch circuit while the elapsed time display timer is operating, and the display selection circuit fixes the elapsed time display regardless of the operation of the elapsed time display timer circuit.

The first embodiment of this invention mentioned above will now be described with reference to the accompanying drawings.

Figure 1:
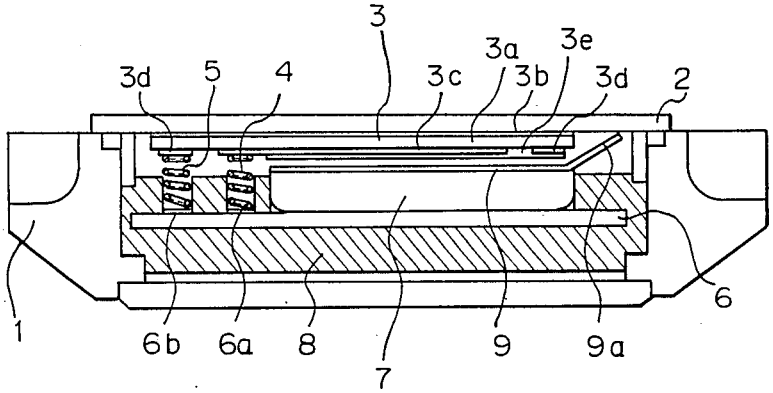
FIG. 1 is a sectional view of one embodiment of the stop watch ,of this invention taken along the arrow line A—A in FIG. 2.
Figure 2:
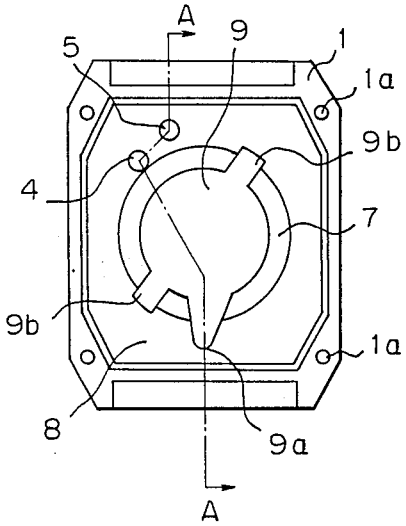
FIG. 2 is a plane view of a back of the watch as shown in FIG. 1 with the back cover thereof removed.
Figure 3:
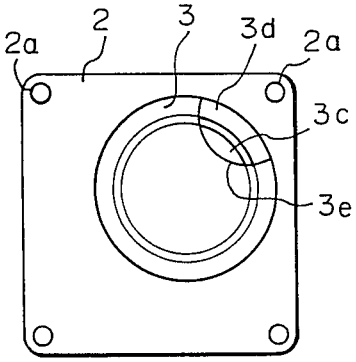
FIG. 3 is a plane view of an inside surface of the back cover of the watch shown in FIG. 1.

FIGS. 1 to 3, show a body 1 of a watch case according to this invention.

Figure 10:
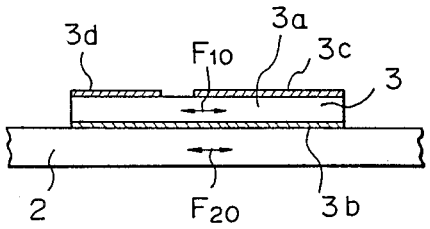
FIG. 10 is an enlarged cross sectional view of the piezo electric element shown in FIG. 3.

As shown in FIG. 2 and FIG. 3, and FIG. 10 the body 1 is provided with four screw holes la at each corner thereof, and the back cover 2 is provided with screw holes 2*a* as shown in FIG. 3, at each corner thereof, and thus the back cover 2 is fixed to the body 1 of the watch case by screws (not shown).

As shown in the FIGS., a piezo electric element 3 is provided with electrodes 3*b*, 3*c*, and 3*d* fixed on both surfaces of a piezo electric material 3*a* made, for example, of lead zirconia titanate (PZT). Namely, the piezo electric element 3 is provided with an electrode 3*b* covering the entire surface of one side of the piezo electric element 3 and facing to the back cover 2, and with two separate electrodes 3*c* and 3*d* on the surface of the opposite side thereof. The piezo electric element is fixed to the inner surface of the back cover 2 by an adhesive. An insulating material 3*e* is provided over the surfaces of both electrodes 3*c* and 3*d* to prevent an electrical short circuit with other elements of the watch A printed circuit board 6 is provided with the circuitry (not shown) for the watch as described later. The printed circuit board is provided with an alarm electrode 6*a* , which outputs a voltage signal to the piezo electric element 3 for generating an alarm sound, and a detecting electrode 6*b* for receiving a voltage signal generated from the piezo electric element 3.

A connecting spring 4 connects the alarm electrode 6*a* to the electrode 3*c* of the piezo electric element 3 and a connecting spring 5 connects the detecting electrode 6*b* to the electrode 3*d* of the piezo electric element 3. A battery 7 and a module 8 are also provided in the watch, and a battery support plate 9 is provided for fixing the battery 7 to the module 8. The battery support plate 9 has a large projection 9*a* for connecting a plus electrode of the battery 7 to the back cover 2 and two smaller projections 9*b* for fixing the battery 7 to the module 8 of the watch.

Accordingly, when the back cover 2 shown in FIG. 3 is fixed to the back of the watch body 1 shown in FIG. 2, a portion of the electrode 3*c* which is not covered with the insulating material 3*e* is connected by the connecting spring 4 to the alarm electrode 6*a* provided on the printed circuit board 6, and simultaneously, a portion of the electrode 3*d* which is not covered with the insulating material 3*e* is connected by the connecting spring 5 to the detecting electrode 6*b* provided on the printed circuit board 6, and thus the connecting condition shown in FIG. 1 is realized. Accordingly, an alarm signal developed at the printed circuit provided on the printed circuit board 6 is input to the electrode 3*c* of the piezo electric element 3 from the alarm electrode 6*a* through the connecting spring 4. Further, the electrode 3b of the piezo electric element 3 is connected to a plus (+) electrode of the battery 7 by the contact between the back plate 2 and the battery support plate 9, and accordingly, the piezo electric material 3a of the piezo electric element 3 receives a voltage signal as an alarm signal from the electrodes 3b and 3c and the piezo electric material 3a generates a distortion based upon a piezo electric phenomena along the direction shown as F10 in FIG. 10, and thus an alarm sound is generated by a vibration acting on the back plate 2 in the direction shwon as F20 in FIG. 10.

As already known, a voltage corresponding to the distortion of the piezo electric material will be generated where the electrodes 3b and 3d of the piezo electric element 3 are arranged face to face. This signal is a voltage signal which is generated at the same time as the alarm sound, and in the same manner; i.e., the vibration generated by an impact on the watch case body 1 or back plate 2 is transmitted to the piezo electric element 3 through the back plate 2, and this vibration causes a voltage signal to be generated between the electrodes 3b and 3d of the piezo electric element 3.

As described above, the voltage signal developed at the electrode 3d is transmitted to the electrode 6b of the printed circuit board 6 through the connecting spring 5, and is then input to the watch circuit (described later) on the printed circuit board 6.

Figure 6:
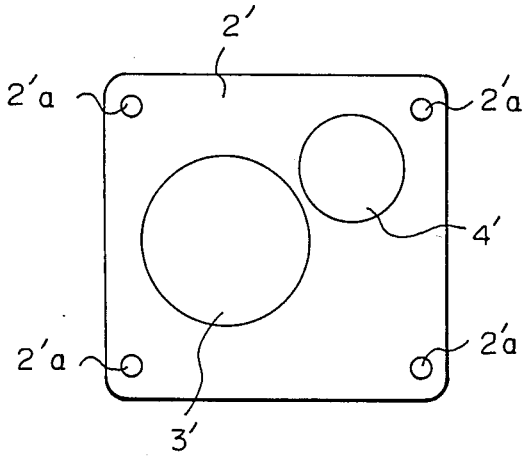
FIGS. 6 and 7 show another embodiment of the arrangement of the piezo electric elements according to this invention; and, FIGS. 8 and 9 show a preferable embodiment of a discriminating circuit according to this invention.
Figure 7:
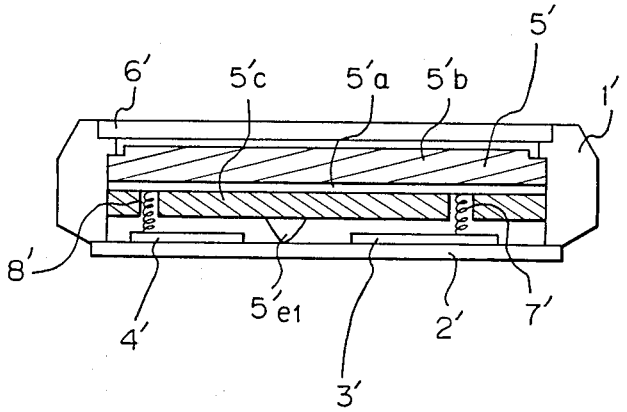
Figure 11:
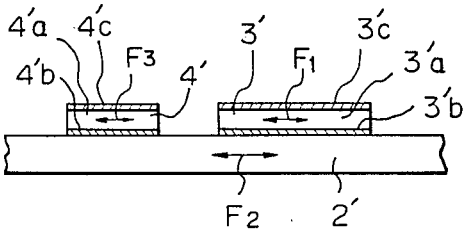
FIG. 11 is an enlarged cross sectional view of the piezo element shown in FIG. 7.

The configuration of the piezo electric element used in this invention is not restricted to that mentioned above, and any known arrangement of a piezo electric element can be utilized. However, the type of arrangement of the piezo electric elements as mentioned in FIG. 6, FIG. 7 and FIG. 11 is preferably used in this invention. This arrangement is composed of a first piezo electric element 3' for generating an alarm sound and a second piezo electric element 4' for a detecting an impact force loaded on the watch case, wherein the first piezo electric element 3' and the second piezo electric element 4' have a flat configuration, and further, when fixed in the watch case, a plane area of the second piezo electric element 4' is not larger than that of the first piezo electric element 3'.

Further in the FIG. 11, 3' denotes a piezo electric element for generating an alarm as shwon in FIG. 11 a piezo electric material 3'a is provided having an electrode 3'b on one surface thereof and another electrode 3'c on the opposite side surface thereof, the electrode 3'c being fixed to the inner surface of the back cover 2 with an adhesive, and 4' denotes a piezo electric element for detecting an impact force. As shown in FIG. 11, the piexo electric material 3'a is provided an electrode 4'b on one surface thereof and another electrode 4'c on the opposite side surface thereof, the electrode 4'c being fixed to the inner surface of the back cover 2 with an adhesive. As indicated in FIG. 7, the plane area of the piezo electric element 4' for detecting an impact force is smaller than that of the piezo electric element 3' for generating an alarm.

As also illustrated in FIG. 7, 7' is a connecting spring for transmitting an alarm drive signal generated from the watch circuit mounted on the printed circuit board 5'a to the electrode 3' of the piezo electric element for generating an alarm and 8' is a connecting spring for detecting an impact force and transmitting an impact signal generated at the electrode of piezo electric element 4 for detecting an impact force to the impact detecting circuit mounted on the printed circuit board 5'a.

The system of operating the stop-watch by using a impact pulse (PS) by discriminating a voltage signal generated by an impact force from a voltage signal generated by an alarm operation will be explained with reference to FIG. 4 and FIG. 5.

Figure 4:
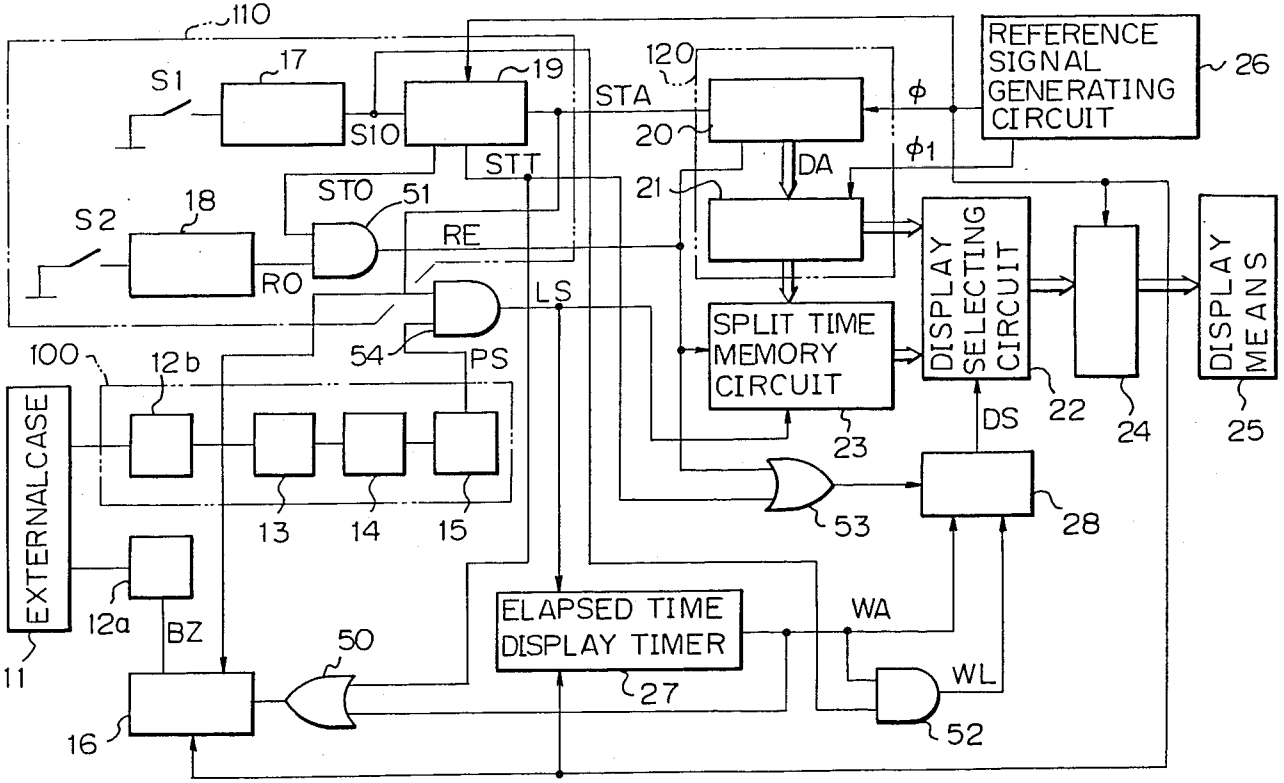
FIG. 4 is a block diagram of the watch system according to this invention.
Figure 5:
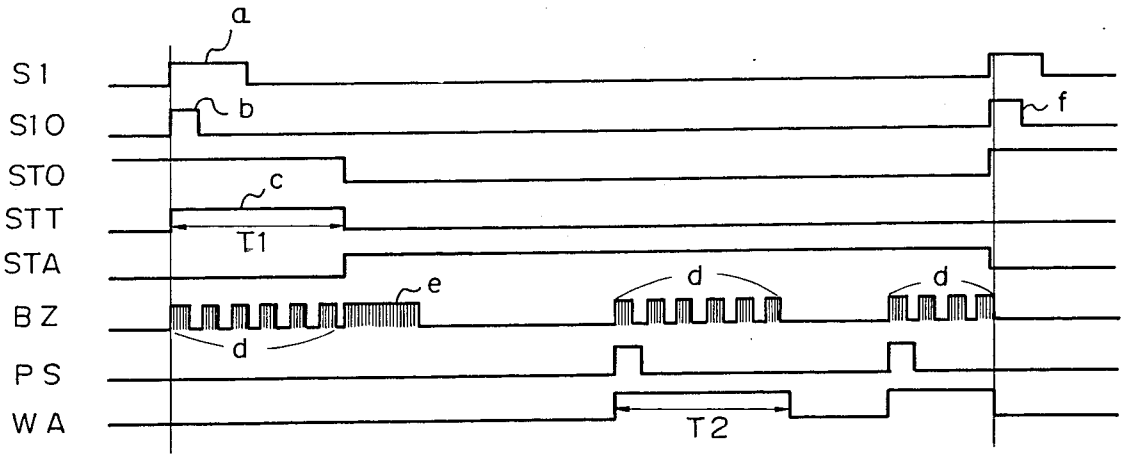
FIG. 5 is a time sharing chart of the watch according to this invention.

FIG. 4 is a block diagram of the system of a stop-watch of this embodiment and FIG. 5 is a time sharing chart indicating the flow of signals in parts of this system. In FIG. 4, 11 is an external case corresponding to the watch-case body 1 and back cover 2 of FIG. 1 to FIG. 3, and 12a and 12b are piezo electric elements corresponding to the element 3 of FIG. 1 to FIG. 3

That is, 12a is a first piezo electric element corresponding to the piezo electric element 3 clamped between the electrodes 3b and 3c of FIG. 1, and 12b is a second piezo electric element corresponding to the piezo electric element having both electrodes 3b and 3d

Also, 13 is a detecting circuit for detecting a voltage signal generated by the second piezo electric element 12b, and 14 is a discriminating circuit for developing only a voltage signal generated by a striking of the external case, by discriminating from the voltage signal generated by the detecting circuit 13 differences in the voltage levels of the voltage signal generated by the alarm action of the first piezo electric element 12a and the voltage signal generated by the striking of the external case 11. A pulse generating circuit 15 generates an impact pulse signal (PS) from a signal output by the discriminating circuit 14 upon a striking of the external case 11.

The second piezo electric element 12b, detecting circuit 13, discriminating circuit 14, and pulse generating circuit 15 herein form an impact force detecting circuit block 100. An alarm driving circuit 16 generates an alarm by applying a high voltage signal to the first piezo electric element 12a. The alarm driving circuit 16 generates a continual sound for 0.5 second when receiving a start signal (STA), and generates an intermittent sounds of 1 Hz when receiving a signal output from an OR gate 50. Next, an external operation switch circuit block 110 will be explained, wherein $S_1$ and $S_2$ are switches which can be operated by the user; $S_1$ being a start/stop switch and $S_2$ a reset switch.

A one shot circuit 17 outputs a one shot start pulse $S_{10}$ when the start/stop switch $S_1$ is made ON, and a one shot circuit 18 outputs a one shot reset pulse RO when the reset switch $S_2$ is made ON. In a circuit 19 a start timer starts to operate for a predetermined time interval when receiving the one shot start pulse $S_{10}$ from the one shot circuit 17, and a start wait signal STT is generated and is brought to an "H" level. After a predetermined time interval $T_1$ has passed and the start wait signal STT becomes "L" level, then a start signal STA becomes "H" level and a stop signal STO becomes "L" level. (The stop signal STO is "H" level when the start signal STT is "L" level.)

Namely, the circuit 19 is a timer start circuit for controlling the generation of a start signal STA after receiving the one shot start pulse $S_{10}$ and a predetermined time interval has passed. Also provided is an AND gate 51.

A stop watch circuit block 120 will be explained as follows.

A stop-watch counter circuit 20 counts a reference signal $\phi$ when the start signal STA is "H" level and generates counted data DA as an elapsed time, and stops the generation of the signal for counting when the start signal STA becomes "L" level.

A display latch circuit 21 latches the counted data in synchronization with the reference signal $\phi_1$ generated by the stop-watch counter circuit 20 and outputs the data to the display selection circuit 22 and the elapsed time memory circuit 23. The elapsed time memory circuit 23 memorizes the new data output (a new elapsed time) by the display latch circuit 21 every time an impact lap signal LS described later is received and outputs the memorized data to the display selection circuit 22.

The display selection circuit 22 selects one operation from two alternatives, i.e., to display the output of the display latch circuit 21, which is an elapsed time of the stop-watch, at the display means 25, or to display the output of the elapsed time memory circuit 23, which is a latest elapsed time, at the display means 25. The display selection circuit 22 outputs the content of the output of the elapsed time memory circuit 23 to a display drive circuit 24 upon receiving a display switching signal DS.

The display driving circuit 24 outputs a drive signal for driving the display means 25 corresponding to the output of the display selection circuit 22; 26 is a reference signal generating circuit and 27 is a elapsed time display timer which counts the reference signals in synchronization with the input the impact lap signal LS, and generates the elapsed time display signal WA for a predetermined time.

The elapsed time display timer 27 starts to count the signal from the initial value each time the impact lap signal LS is received. Namely, the elapsed time display timer 27 generates the elapsed time display signal WA for a predetermined time interval, starting from the time the latest impact lap signal LS is input thereto. A selecting signal generating circuit 28 generates a display switching signal DS when receiving the elapsed time display signal WA and fixes the display switching signal DS with a display locking signal WL output by the AND gate 52 while receiving the elapsed time display signal WA, and the output of the display switching signal DS generated by the selecting signal generating circuit 28 is made "L" level by the output of the OR gate 53.

The preferred embodiment of the discriminating circuit 14 according to this invention will be described hereunder with reference to FIGS. 8 and 9.

Figure 8:
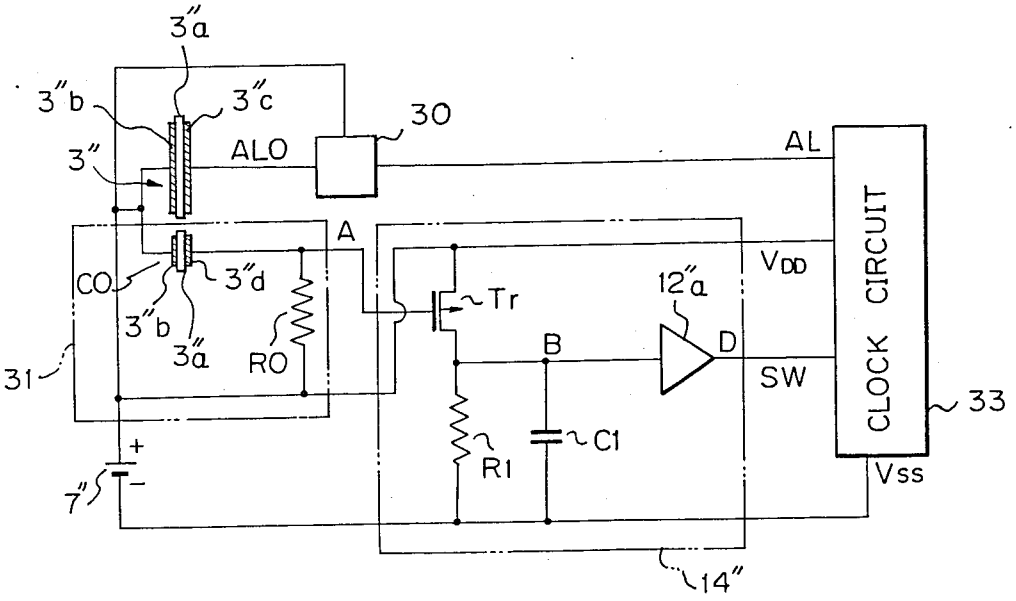

In FIG. 8, 3'', 3''a, 3''b, 3''c, 3''d, and 7'' represent the same parts designated as 3, 3a, 3b, 3c, 3d, and 7 in FIG. 1. In the Figure, 30 denotes an alarm signal amplifier circuit and 31 denotes a detecting circuit for detecting the voltage signal generated by the piezo electric element 3''. This detecting circuit 31 consists of a capacitor Co, depending upon the unit area of the piezo electric material 3''a, which is clamped by the electrodes 3''b and 3''d of the piezo electric element 3'', and a resistor Ro. Numeral 14'' denotes a discriminating circuit per se which receives a detecting signal A output from the detecting circuit 31 and generates a pulse signal D having a pulse duration longer than the predetermined pulse duration by discriminating a signal among the detecting signals A received having a level higher than the predetermined level.

The discriminating circuit 14'' consists of a field effect type MOS transistor (hereafter referred to as MOS transistor) Tr, a resistor $R_1$, a capacitor $C_1$ for determining the pulse duration, and a buffer 12''a for generating a pulse. The circuit 14'' also includes a clock circuit 33 having an alarm output terminal AL outputting an alarm signal to the alarm signal amplifier circuit 30, a switch input terminal SW, a positive power source terminal $V_{DD}$, and an negative power source terminal $V_{SS}$. When an alarm signal is output from the alarm output terminal AL of the clock circuit 33, and is input to the alarm signal amplifier circuit 30, the alarm signal amplifier circuit 30 converts the signal to a signal having a substantially constant voltage and high frequency, to vibrate the piezo electric element 3''. Namely, when such a voltage signal output by the output terminal $AL_O$ of the alarm signal amplifier circuit 30 is received at the electrode 3''c of the piezo electric element 3'', the piezo electric element 3'' generates an alarm sound because of a distortion caused by the piezo electric effect. At the same time, in the detecting circuit 31, a voltage signal generated by the distortion caused by the alarm sound, is generated at the electrode 3''d of the piezo electric element 3''. On the other hand, in the detecting circuit 31, a high pass filter circuit formed by a capacitor Co and resistor Ro operates in such a way that a signal generated by the piezo electric element 3'' and having a low frequency is cut, and a signal having a frequency higher than the predetermined value is selected and output as a signal A detected by the detecting circuit 31. Accordingly, the voltage signal generated by the alarm sound, which is at a low level, is not generated as a detecting signal.

The configuration of the detecting signal A is shown in FIG. 9A, wherein Al represents the alarm detecting signal generated by the alarm sound and having a voltage $V_{AL}$.

Next, when an impact is given to the stop watch, the impact force is transmitted to the back cover plate, which starts to vibrate and thus induce distortion of the piezo electric element 3''. The impact detecting signal generated by the impact force has the configuration shown as A2 in FIG. 9.

The voltage value of the impact detecting signal A2 is $V_{SK}$, which is generally larger than $V_{AL}$.

The detecting signal A detected by the detecting circuit 31 and including both voltage values of $V_{AL}$ and $V_{SK}$ is transmitted to the discriminating circuit 14''. In the discriminating circuit 14'', the detecting signal A is input to the gate terminal of the MOS transistor Tr. If the signal has a voltage value higher than the threshold value $V_{th}$ when input to the gate of the MOS transistor Tr, the drain-source of the transistor Tr becomes ON and the voltage at the terminal B becomes a value closest to that of the power source $V_{DD}$, i.e., (+0) V.

Figure 9:
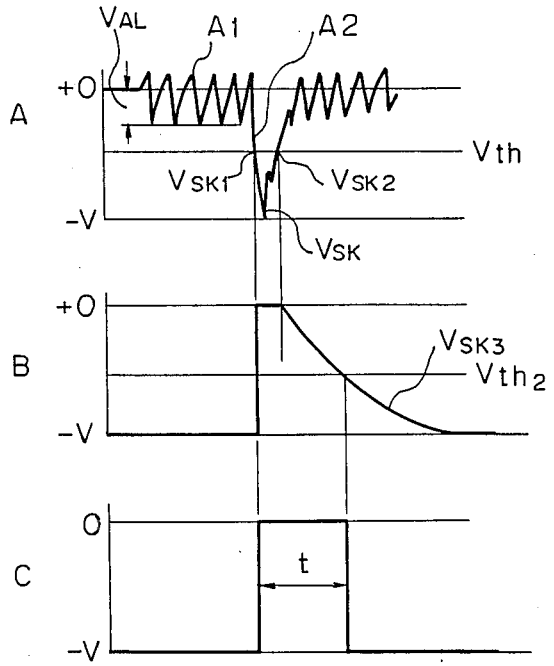

As shown in FIG. 9, the voltage value $V_{AL}$ of the alarm detecting signal A1 is far smaller than the value $V_{SK}$ of the impact detecting signal A2, and it is possible for the voltage value $V_{AL}$ to be smaller than the threshold value $V_{th}$.

Here, assuming that the voltage value when the voltage value $V_{SK}$ of the impact detecting signal A2 crosses the threshold value $V_{th}$ from high level to low level is $V_{SK1}$, and the voltage value when the voltage value $V_{SK}$ crosses the threshold value $V_{th}$ from low level to high level is $V_{SK2}$, when the alarm detecting signal A1 is input to the gate of the transistor Tr, the voltage value of the source-gate of the MOS transistor Tr is low, i.e., the transistor $T_R$ is turned OFF. Next, when the $V_{SK1}$ period approaches, the signal having a voltage value higher than the threshold value $V_{th}$ is input to the MOS transistor Tr, and therefore, the voltage value at the source-gate becomes high, i.e. the transistor $T_R$ is turned ON. Accordingly, the capacitor $C_1$ is charged and the voltage at the terminal B becomes 0 V.

Then when the $V_{SK2}$ period is reached, the condition of the source-gate is changed to OFF because a voltage lower than the threshold value $V_{th}$ is input to the gate of the MOS transistor Tr. Accordingly, the electric charge in the capacitor $C_1$ is discharged in accordance with the discharging characteristic of the capacitor $C_1$ and resistor $R_1$, as shown in FIG. 5, and the voltage value at the terminal B decreases gradually to −V level. The configuration of the voltage value at the terminal B is shown in FIG. 9B. The signal shown in FIG. 9 is formed into a pulse in the buffer 12''a with a threshold value of $V_{th2}$ and is output to the switch input terminal SW of the clock circuit 33 as the pulse signal shown in FIG. 9D. This signal can be input to the input terminal of the AND circuit 54 shown in FIG. 4.

The operation of this invention will be explained hereafter with reference to FIG. 5.

The start/stop switch $S_1$ is turned ON by a signal a in FIG. 5, and the $S_1$ one shot pulse circuit 17 then generates a one shot start pulse $S_{10}$ with a signal b in FIG. 5. This one shot start pulse $S_{10}$ is input to the AND gate 52 but cannot pass through this gate 52 because the elapsed time display signal WA is "L" level. On the other hand, a one shot start pulse $S_{10}$ is input to the starting timer 19, and the starting timer 19 generates a start wait signal STT for a predetermined time interval $T_1$.

The starting signal STA is then made "H" level, and at the same time, the stop signal STO becomes "L" level, in synchronization with the shift of the starting signal STA to "H" level.

The start wait signal STT is input to the selecting signal generating circuit 28 through the OR gate 53, to reset the circuit 28.

The start wait signal STT is then input to the alarm drive circuit 16 through the OR gate 50, and therefore, the alarm drive circuit 16 generates an intermittent signal, such as the signal d shown in FIG. 5, by receiving the signal output by the OR gate 50 and outputs that signal to the first piezo electric element 12a, thus causing the first piezo electric element 12a to generate an intermittent buzzer sound through the external case 11. As mentioned above, after the predetermined time interval $T_1$ has passed, the start signal STA is made "H" level, the start signal STA is then input to the alarm drive circuit 16, and thereafter, the circuit 16 generates an alarm drive signal for generating a continual sound, such as the signal e shown in BZ in FIG. 5, and this signal is output to the first piezo electric element 12a.

As described above, when the start/stop switch $S_1$ is turned ON, a short, intermittent sound is generated as an advance warning, and a prolonged sound is generated as an alarm for starting.

When the starting signal STA is generated, the stopwatch counter 20 starts to count the reference signals $\phi$ and the counted data DA representing the elapsed time is latched by the display latch circuit 21 in synchronization with the reference signal $\phi_1$ and is output to the display selection circuit 22.

At this time, as the display switching signal DS is "L" level, the display selection circuit 22 outputs the counted data DA from the display latch circuit 21 to the display drive circuit 24, and thus the elapsed time can be displayed at the display means.

Thereafter, when the external case is struck, as indicated in FIG. 1 to FIG. 3, a second piezo electric element 12b outputs a voltage which is received as a detected voltage signal in the detecting circuit 13. The discriminating circuit 14 outputs only a signal detected as a signal caused by an impact, and thereafter an impact pulse signal PS is output from the pulse generating circuit 15.

At this time, as the starting signal STA is "H" level, the AND gate 54 is made ON, and therefore, the impact pulse signal PS can pass therethrough, and thus an impact lap signal LS is output from the AND gate 54.

On the other hand, the split time memory circuit 23 receives the impact lap signal LS and memorizes an elapsed time data when the memory operation is carried out, from the display latch circuit 21, and stores this data in the memory. Thereafter, the memorized data is output to the display selection circuit 22. On the other hand, when the impact lap signal LS is input to the elapsed time display timer 27, the elapsed time display timer 27 generates an elapsed time display command signal WA for a predetermined time interval $T_2$, the selecting signal generating circuit 28 then receives the elapsed time display command signal WA and outputs the display switching signal DS, and thus the display selection circuit 22 is switched to allow an output of the elapsed time memory circuit 23 to be output to the display drive circuit 24. The elapsed time display command signal WA is also input to the alarm drive circuit 16 through the OR gate 50, and therefore, an intermittent sound is generated as mentioned above. As described above, an impact on the external case causes an impact lap signal LS to be generated, and each time this signal is generated, a new split time data is memorized in the elapsed time memory circuit 23, and at the same time, it is displayed as an elapsed time for a predetermined time interval $T_2$ while an intermittent sound is generated by the first piezo electric element 12a. Further, when the start/stop switch $S_1$ is made ON, the one shot start pulse $S_{10}$ is output as described above. This corresponds to the signal f shown in FIG. 5.

When the start timer 19 receives the one shot start pulse $S_{10}$, the output thereof is stopped and the start signal STA is made "L" and the stop signal STO is made "H".

On the other hand, the stop watch counter 20 stops counting the reference signal $\phi$, while the one shot start pulse $S_{10}$ output at this time is input to the AND gate 52 and output therefrom as a display lock signal WL, because the elapsed time display signal WA is "H" level.

The selecting signal generating circuit 28 receives the display lock signal WL and holds the display switching signal DS at the "H" level even after the elapsed time display signal WA is made "L" level. Namely, in this system, the elapsed time is realized by the impact pulse signal PS generated by the striking of the external case 11 and this elapsed time is displayed at the display means as an elapsed time display for a predetermined time interval $T_2$. During that time, when the start/stop switch $S_1$ is turned ON, the stop watch counter 20 stops counting but the latest elapsed time is retained and displayed without displaying the content of the count number in the stop watch counter 20.

Next, when the reset switch $S_2$ is turned ON, the one shot reset circuit 18 outputs the reset pulse RO. Since the stop watch is now stopped, the stop signal STO is "H" level and thus the AND gate 51 is made ON, and therefore, the reset pulse RO can pass through the AND gate 51 and be output as the reset signal RE. Upon receiving this reset signal RE, the stop watch counter 20 is reset to zero and the elapsed time memory circuit 23 is cleared. Further, the selecting signal generating circuit 28 is also reset through the OR gate 53 and the display switching signal DS is made "L" level.

As described above, at the start of, for example, a skiing race, the start switch $S_1$ is first turned 0N and an advance warning is generated, and thereafter the skier begins the race while accompanied by a continual warning sound. If, during skiing, the watch receives an impact when, for example, the skier hits the watch or jars the watch by hitting the surface of the snow, the impact pulse signal PS is developed, an elapsed time is displayed at the display means 25, and the intermittent warning is generated.

However, these impacts do not affect the stop-watch functions, and when the skier intentionally strikes the stop-watch with any portion of the body when reaching the end of the race, the latest elapsed time at that moment is displayed and the intermittent warning sounded. When the start/stop switch $S_1$ is operated when the intermittent warning is heard, the latest split time at which the skier reached the finish point is fixedly displayed at the display means until the rest switch $S_2$ is pushed.

Next, a second preferred embodiment of this invention will be described.

In the first embodiment, an elapsed time memory circuit and display selecting circuit are provided in the stop watch circuit. The second embodiment consists only of an elapsed time measuring circuit and a latch circuit, eliminating those circuits, and can change a display condition of the elapsed time data at the display means by controlling latch circuit.

However, in this embodiment, an external watch case, a piezoelectric element and an impact force detecting circuit are the same as used in the first embodiment.

This embodiment is characterized in that memory circuits memorizing a plurality of the elapsed time data are additionally provided, but it is apparent that these memory circuits per se also can be used in the first embodiment.

Regarding the memorizing of an elapsed time data, the stop watch in the first embodiment can convert a counted measured time to both an elapsed time and a stopping time.

When several memory circuits are provided in this kind of watch, and assuming that it is used in a ski race with many poles set in the course, there are many occasions which the skier may suffer an impact from these poles during the skiing, and therefore an impact will make the stop watch measure an elapsed time at every impact.

Accordingly, it becomes very difficult to recognize which data is an actual elapsed time when the data is retrieved after the race is over.

Moreover, even if such memorized data could be retrieved with a mark indicating that the data is an elapsed time or stop time, respectively, and it was possible to identify which is which, a data obtained at the time of an impact by the poles on the skier is superfluous. In this system, it is apparent that it would take a long time to retrieve the required elapsed times.

Therefore, in this second embodiment, a stop watch having a different display system from that of the first embodiment and having a system for memorizing and retrieving the most important elapsed time data is provided.

FIGS. 12 to 17 illustrate a second embodiment according to this invention.

Figure 16:
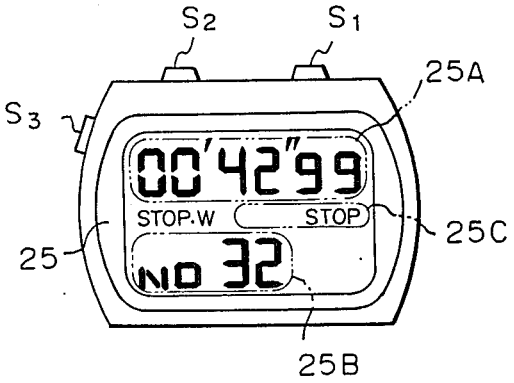
FIGS. 16 and 17 are plane views showing different modes of the display conditions of an electronic watch of this embodiment.
Figure 17:
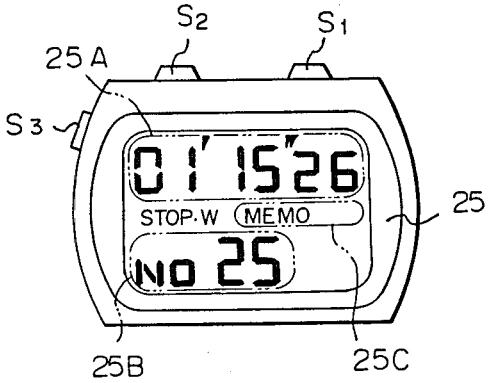

FIG. 16 is a plane view of an electronic watch indicating a fixed display in a stop watch mode and FIG. 17 is the same plane view indicating a display of data retrieved.

First, a display configuration of a display means 25 will be explained.

The display means 25 is provided with a first display portion 25A for displaying a time elapsing during a measurement operation, an intermediate time measured, i.e., an elapsed time, and the final measured time i.e., a stop time, and a second portion 25B for displaying a number of times operation was stopped during the time measurement mentioned later and for displaying the number of stop times at which a data displayed in the portion 25A was obtained, and further is provided with a mark display portion 25C for displaying the contents of data displayed at the first display portion 25A.

A start switch $S_1$ is a switch for operating a start and stop of the watch and $S_2$ is a switch for operating an elapsed time and a data retrieval operation of the watch. $S_3$ is a mode switch for retrieving a stop watch function of the watch.

Accordingly, as shown in FIG. 16, "STOP" is turned ON in a mark display portion 25C and in a second display portion 25B and in a first display portion 25A, "No. 32" and "00 minutes, 42 seconds, 99" are displayed, respectively; i.e., the elapsed time at the 32nd attempt was 42.99 seconds.

Further, as shown in FIG. 17, "MEMO" in the display portion 25C is turned ON indicating that the display portion 25C is in a memory condition, and in the first display portion 25A, a time of "1 minute 15 seconds, 26" is displayed. In the second display portion 25B, "No. 25" is displayed, indicating that the data displayed in the first display portion 25A was obtained at the 25th attempt.

Figure 12:
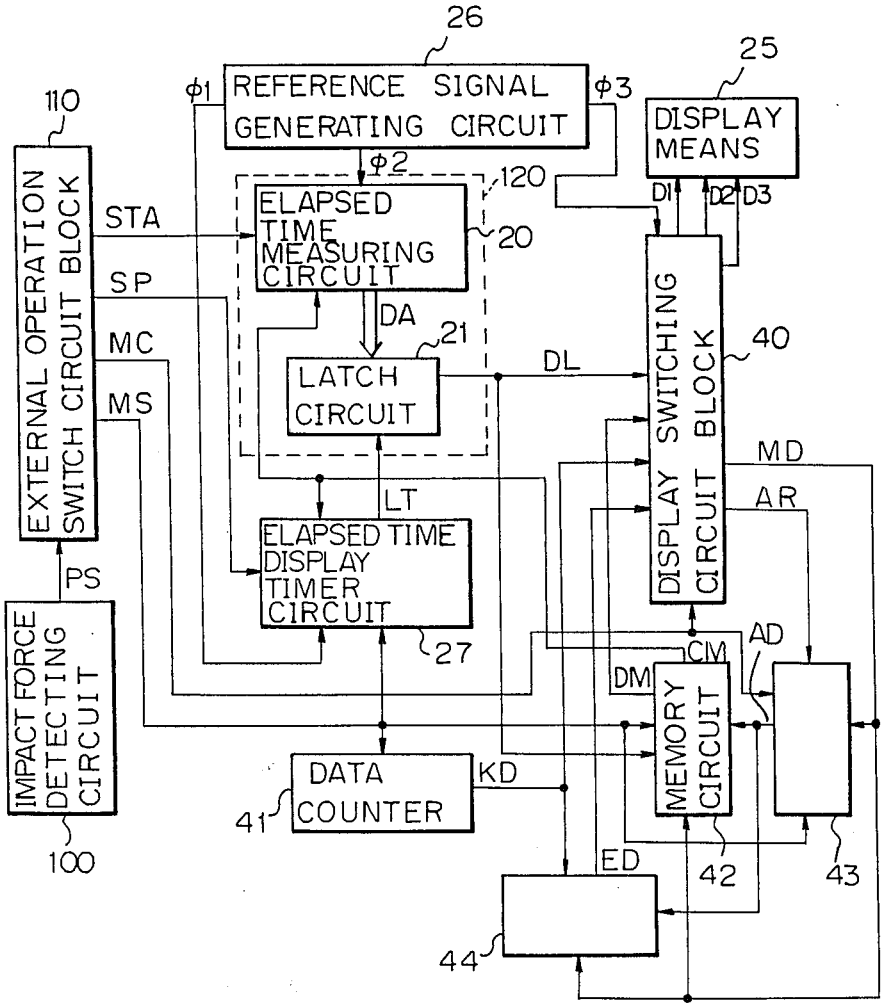
FIG. 12 is asystem chart of an electronics watch in a second of this invention.

Next, a stop watch system of the watch of this embodiment will be explained. FIG. 12 shows the whole system of this embodiment, wherein 25 denotes a display means shown in FIGS. 16 and 17 and a display switching circuit 40 selectively outputs data for display at the display means 25, namely, outputs data to be displayed at the first display portion 25A of the display means 25 as a first display data $D_1$, data to be displayed at the second display portion 25B of the display means 25 as a second display data $D_2$, and data to be displayed at the display portion 25C as a third display data $D_3$, respectively. Further, when the data stored in a memory is retrieved, a memory display signal MD is output.

Numeral 26 denotes a reference signal generator circuit, and an elapsed time measuring circuit 20 counts a reference signals $\phi_2$ and outputs an elapsed time data DA.

The elapsed time measuring circuit 20 counts the time reference signals $\phi_2$ while the start signal STA is ON, stops the counting operation when the start signal STA is OFF, and is reset when a memory completion signal CM is input.

A latch circuit 21 latches an elapsed time data DA in synchronization with a latch timing signal LT and outputs a latch output data DL; an external operation circuit block 110 including a start switch $S_1$ and a split switch $S_2$ controls the elapsed time measuring circuit 20; an impact force detecting circuit 100 outputs an impact detecting signal PS by detecting the impact force loaded on a watch case; a display timer circuit 27 controls an output of the latch timing signal LT for a fixed display of an elapsed time at the display means for a predetermined time interval; a data counter 41 counts the number of times a measurement is carried out; and, a memory circuit 42 sequentially memorizes data of a measured elapsed time and is provided with a capacity in which, for example, ten data of the measured elapsed time data can be stored.

Accordingly, this memory has address numbers 0 to 9.

In the first step, when the first memory address signal MS is input to the memory circuit 42, latch output data DL is registered in the address 0 of the memory circuit 42, and in the second step, when the second memory address signal MS is input thereto, a new latch output data DL is registered in the address 0, while the content of the data previously registered in the address 0 is transferred to the address 1, and so on.

The registering operation is carried out as described above, but when data is input thereto after all of the address portions of the memory circuit are holding data, then the data registered in address 9 is erased and the data registered in address 8 is shifted to address 9, and so on.

In the manner as mentioned above, the memory circuit always holds the latest 10 data of the latch output data DL output in synchronization with the memory address signal MS.

An address designating circuit 43 controls the registering operation of the memory circuit 42 in synchronization with an input of the memory address signal MS and controls the output of the data from the memory circuit 42 by determining which of the addresses should be selected for outputting the data while the memory display signal MD is input thereto.

An arithmetic control circuit 44 outputs a calculated data ED which is obtained by subtracting data of an address signal AD, from an address designating circuit 43, from a counting data KD of a data counter 41 while memory display signal MD is input to the memory circuit.

Next, a display switching circuit block 40 in FIGS. 13A and 13B will be explained. A first display selecting circuit 121 selects a display content to be displayed at a first display portion 25A, as explained in FIGS. 16 and 17, and latch output data DL and memory data DM are both input to this circuit. In this condition, when a memory display signal MD is input thereto, at memory signal DM is output therefrom as a first display data $D_1$ and a latch output data DL is output as a first display data $D_1$ when a memory display signal MD is not input thereto. A second display selecting circuit 122 selectively outputs the data to be displayed at a second display portion 25B, outputs a calculated data ED as a second display data $D_2$ when a memory display signal MD is input thereto, and outputs a count data KD as a second display data D2 when a memory display signal MD is not thereto.

A selecting circuit 123 outputs data commanding the symbol to be displayed in the display portion 25C, and when a memory address signal MS is input thereto, "STOP" is displayed as shown in FIG. 16, and when a memory display signal MD is input thereto, "MEMO" is displayed as shown in FIG. 17.

Figure 13A:
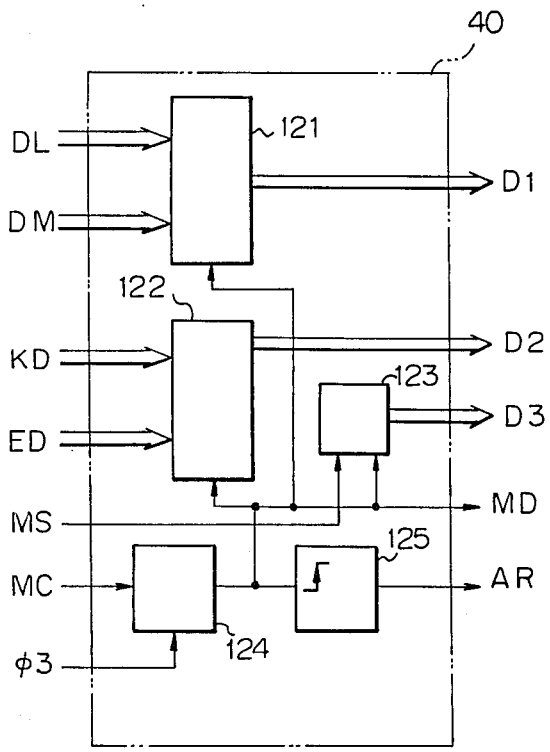
FIG. 13A is a system chart of the display switching circuit.
Figure 13:
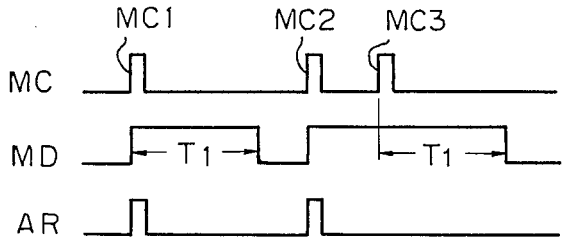

A memory display timer 124 holds a display of memory data DM for a predetermined time interval and counts a reference signal $\phi_3$ every time an address increment signal MC is input thereto, as shown in FIG. 13, and outputs a memory display signal MD for a predetermined time interval $T_1$. The memory display timer 124 carried out a fly-back count when an address signal MC is input thereto.

A one shot circuit 125 outputs a pulse as an address reset signal AR every time a memory display signal MD is input thereto.

A display switching circuit block 40 first outputs a memory display signal MD for a predetermined time interval $T_1$ counting from the time when a memory display timer 124 operation is started by an input of an address increment signal $MC_1$, and outputs an address reset signal AR.

A first display selecting circuit 121 outputs a memo data DM as a first display data $D_1$ therefrom and a second display selecting circuit 122 outputs calculated data ED as a second display data $D_2$, and further, a selecting circuit 123 starts the display of "MEMO" when the memory displaying signal MD is ON.

After a predetermined time interval has passed, an output of a memory display signal MD is stopped, and therefore the first display selecting circuit 121 converts the calculated data DA into a first display data $D_1$ while the second display selecting circuit 122 outputs a counted data KD as a second display data $D_2$ and the selecting circuit 123 stops the display of "MEMO".

As indicated in FIG. 13B, when an address increment signal $MC_3$ is input thereto again after the address increment signal $MC_2$ is input, but before the predetermined time interval has passed, a memory display timer 124 starts to count a signal again from the time when the address increment signal $MC_3$ is input thereto. At this time, when the address increment signal $MC_3$ is input thereto, a one shot circuit 125 does not output an address reset signal AR.

That is when an address reset signal AR is once output at the time when a memory display signal MD is output, subsequently, when the next address increment signal MC is input thereto before a predetermined time interval $T_1$ has passed, the output of the memory display signal MD is continued.

Next an external operation circuit block 110 is explained with reference to FIGS. 14A and 14B.

Figure 15:
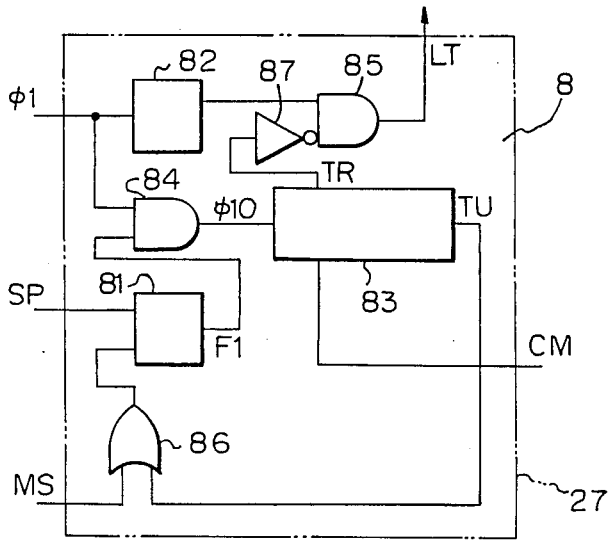
Figure 15:
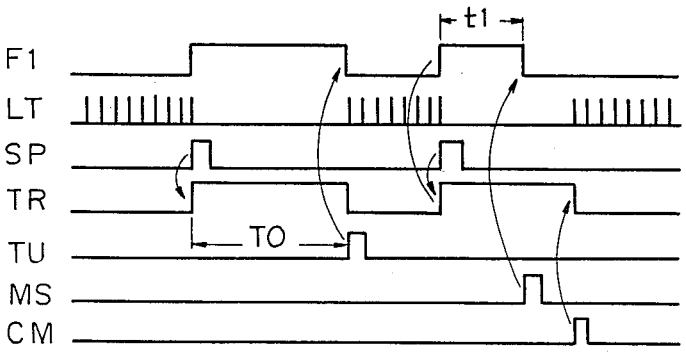

Switches $S_1$ and $S_2$ correspond to a start switch $S_1$ and a split switch $S_2$ in FIGS. 15 and 16 respectively. An one shot circuit 151 outputs a predetermined pulse Pl in synchronization with an ON signal input to the start switch $S_1$ and start flip-flop circuit 152 (hereafter referred to as a start FF) outputs a start signal STA with an input of a pulse signal Pl and stops the output of the start signal STA with the next pulse signal P1.

An one shot circuit 153 outputs a memory designating signal MS as a pulse signal, in synchronization with a trailing edge of the the pulse of a start signal STA which stops an output of STA.

An one shot circuit 158 outputs an elapsed time signal SP in synchronization with a leading edge of a pulse of the output signal of the AND gate 155 and an one shot circuit 159 outputs an address increment signal MC in synchronization with a leading edge of a pulse of the output signal of the AND gate 156. An 0R gate 154 allows an ON signal of a start switch $S_1$ or an impact force detecting signal PS to pass therethrough. In the operation explained with reference to FIG. 14, when a start switch $S_1$ is turned ON, the one shot circuit 151 outputs a pulse Pl and a start FF 152 makes a start signal STA, e.g., signal 1, ON.

In this condition, when a switch $S_2$ is turned ON, the ON signal of this switch $S_2$ is input to the AND gate 155 through the OR gate 154. At this time, the 0N signal of the switch $S_2$ is input to the one shot circuit 158 through the AND gate 155, because the AND gate is in ON when the start signal STA is ON, i.e., 1. Accordingly, the one shot circuit 158 outputs a split signal SP.

When an impact force detecting signal PS is input to the OR gate 154, it is output from the one shot circuit 158 as an elapsed time signal SP through the 0R gate 154 and AND gate 155 in the same way as described above.

At that time the AND gate 156 inputs the start signal STA through an inverter 157, which is OFF because the start signal STA is ON, i.e., 1. Then, when the start switch $S_1$ is turned ON again, the one shot circuit 151 outputs a pulse signal Pl, and this signal Pl causes the start FF to make the start signal STA OFF, i.e., 0. The one shot circuit 153 outputs a pulse signal as a memory designating signal MS when the start signal STA is changed from "1" to "0". When the switch $S_2$ is turned ON while the start signal STA is at "0", i.e., the output of the start signal STA is stopped and the AND gate 156 is conductive, the signal from $S_2$ is input to a one shot circuit 159 through the AND gate 156 and an address increment signal MC is output therefrom.

The explanation of a display timer circuit 27 will be made as follows with reference to FIGS. 15A and B.

In FIG. 15A, a flip-flop (hereafter referred to as FF) 81 makes an output Fl "1" when a split signal SP is input thereto and makes an output Fl "0" when an output of the OR gate 86 is input thereto. A latch timing signal generating circuit 82 dimultiplies a reference signal $\phi_1$ and generates a timing signal suitable for latching an elapsed time data DA of an elapsed time measuring circuit 20 shown in FIG. 12. A timer 83 outputs a time up pulse TU after counting a reference signal $\phi_{10}$ output from the AND gate 84 and when a predetermined time interval has passed, and further, makes a timer-run signal TR ON after it has started to count the reference signal $\phi_{10}$, and makes the timer-run signal TR OFF, i.e., "0" with an output of the time up signal TU or a memory completion signal CM.

As shown in FIG. 15B, suppose that the timer-run signal TR is "0" at first, since the timer-run signal TR is input to the AND gate 85 through an inverter 87, the AND gate 85 is ON.

On the other hand, a latch timing signal LT is output from the latch timing signal generating circuit 82. In this condition, when an elapsed time signal SP is input thereto, the output Fl of the FF 81 is made "1", and therefore, a reference signal $\phi_{10}$ is input to the timer 83 because the AND gate 84 is turned ON. The timer 83, to which the reference signal $\phi_{10}$ is input, makes the timer-run signal TR "1", to thereby stop the latch timing signal LT because the AND gate 85 with the inverter 87 is made OFF.

Moreover, a timer 83 outputs a time up signal TU after a predetermined time interval has passed, and simultaneously, makes the timer-run signal TR "0". Therefore, the AND gate 85 with the inverter 87 becomes ON and outputs a latch timing signal LT, because an output of the latch timing signal generating circuit 82 can pass through the AND gate 85.

When the time up signal TU resets the FF 81 through the OR gate 86, and thus the output Fl of the FF 81 is made "0", the AND gate 84 is OFF. In this situation, when the elapsed time signal SP is again input thereto, the output Fl of the FF 81 is made "1" and the AND gate 84 becomes ON, thereby allowing the reference signal $\phi_{10}$ to pass therethrough.

The timer which starts to count the reference signal $\phi_{10}$ again makes the timer-run signal TR "1", and in the same way, the output of the latch timing signal LT is stopped.

When the memory designating signal MS is input to the OR gate 86 before a predetermined time interval $T_0$ has passed, the FF 81 is reset through the OR gate 86 and the output Fl is converted to "0". Then, the AND gate 84 becomes OFF and stops the output of the reference signal $\phi_{10}$. In the next step, when a memory completion signal CM is input to the timer 83, the timer-run signal TR is made "0" and the latch timing signal LT is output because the AND gate 85 is ON.

Hereafter an operation of a total system of this embodiment will be explained.

When a start signal STA is output from the external operation circuit block, the elapsed time measuring circuit 20 starts to count the reference signal $\phi_2$ in synchronization with the start signal STA and starts to measure the elapsed time. When the latch circuit 21 starts to read an elapsed time data DA in synchronization with the latch timing signal LT of the display timer circuit 27, the data read by the latch circuit 21 is output as a latch output data.

As disclosed in FIGS. 14A and 14B, when the start signal STA is output, an address increment signal MC is not output, and therefore the display switching circuit block 40 outputs a calculated data DL for the first display data $D_1$ and a count data KD of the data counter 41 for the second display data $D_2$, as explained in FIGS. 13A and B. The condition shows a run condition of a stop watch, and in this condition, when the elapsed time signal SP is output from the external operation circuit block 110 and is input to the display timer circuit 27, as explained in FIGS. 15A and B, the circuit 27 stops the output of the latch timing signal LT for a predetermined time interval $T_0$. Accordingly, the latch circuit 21 holds the elapsed time data read by the latch timing signal LT in synchronization with the elapsed time signal SP for a predetermined time interval $T_0$ (i.e., until the time-run signal TR becomes "0", as indicated in FIG. 15) and continues to output the data as a latch output data DL.

The condition shows an elapsed time display.

When the predetermined timer interval $T_0$ has passed, the display timer circuit 27 starts to output the latch timing signal LT again, as explained in FIG. 15, and thus a run of the stop watch is begun again. The elapsed time measuring display condition is created in synchronization with the output of the elapsed time signal SP although, as explained in FIG. 14, the elapsed time signal SP is output by "ON" signal of the split switch $S_2$ or an impact detecting signal PS which is an output of the impact detecting circuit 100. Therefore, when the impact detecting signal PS is output by again striking the outer case of the watch, the external operation circuit block 110 outputs the elapsed time signal SP again and the elapsed time measuring display condition in which an elapsed time is fixedly displayed appears again as mentioned above.

When this condition is created, if the start switch $S_1$ on the external operation circuit block 110 is turned ON, the output of the start signal STA is stopped i.e., the stop watch is stopped.

When the output of the start signal STA is stopped, the elapsed time measuring circuit 20 stops counting the reference signal $\phi_2$. In this situation, the elapsed time data DA of the elapsed time measuring circuit 20 shows an elapsed time measured from the time when the starting operation occurred to the time when the stopping operation occurred.

On the other hand, as explained in FIG. 15, in the elapsed time measuring display condition, the latch output data DL from the latch circuit 21 is an elapsed time which is displayed at the display means 25. Further, the external operation circuit block 110, as explained in FIG. 14, outputs the memory designating signal MS in synchronization with the stopping of the output of the start signal STA, and said memory designating signal MS is input to the display timer circuit 27, and the counting operation of the timer 83 in the display timer circuit 27 is stopped, as described in FIG. 15. Furthermore, the memory designating signal MS is input to the data counter 41 and increments the count data KD by one (+1). On the other hand, with the operation of the memory circuit 42 and the address designating circuit 43 to which the memory designating signal MS is input, the memory content held in the address 9 is cleared and the memory content in the address 8 is stored in the address 9, the memory content in the address 7 is stored in the address 8. Accordingly, in the same way, all of the data stored in the address is shifted and the latest data, which is the output data of the latch circuit 21, is registered in the address 0. Note, the elapsed time which is constantly displayed is stored in the memory circuit 42.

Namely, an elapsed time measurement is carried out by the impact detecting signal PS generated by striking the watch, and when a stopping operation is carried out while the elapsed time is displayed, the elapsed time displayed at that time is memorized in the address 0 in the memory circuit 42.

Further, when the time when the elapsed time is not displayed, that is, during a watch run operation, when a stopping operation is carried out, a memory designating signal MS is output in synchronization with the time when a start signal STA is converted from "1" to "0" and a data number in the data counter 41 is incremented by 1. Meanwhile, the latch output data DL, which is an output data of the latch circuit 21, shows the data when a counting operation by the elapsed time measuring circuit 20 is stopped, depending upon the reason for making the starting signal STA OFF. Namely, this data shows an elapsed time when the stopping operation is carried out, and the elapsed time data is memorized in the address number 0 of the memory circuit 42. As explained above, when the memorizing of the latch output data DL in the address number 0 in the memory circuit by the stopping operations is completed, a memory completion signal CM is output from the memory circuit 42 and is input to both the displaying timer circuit 27 and the elapsed time measuring circuit 20. Therefore, the timer 83 in the display timer circuit 27 is reset as explained in FIG. 15, and thus the display timer circuit again starts to output a latch timing signal LT and the elapsed time measuring circuit 20 is reset by an input of the memory completion signal CM.

As described above, the stop watch of this embodiment can memorize a plurality of elapsed times obtained by the stopping operations in the memory circuit 42, and therefore ten of the latest elapsed times are registered in the memory circuit.

Further, an elapsed time is input to the memory circuit 42 and stored therein and the elapsed time measuring circuit 20 is reset by a memory completion signal CM by one stopping operation.

Therefore, when a next starting operation is carried out, an elapsed time can be measured from the time when the starting operation occurs.

Figure 14:
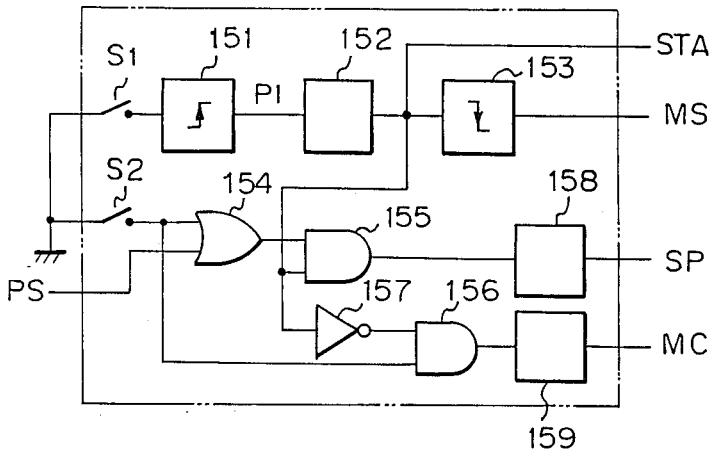
Figure 14:
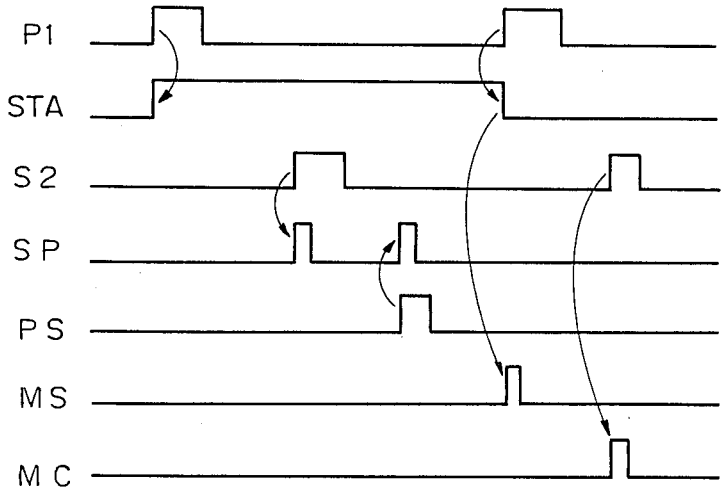

In this situation the elapsed time switch $S_2$ of the external operation circuit block 110 is turned ON, and the address increment signal MC is output as described in FIG. 14 and is input to both the display switching circuit 40 and the address designating circuit 43. Therefore, the display switching circuit 40 outputs an address resetting signal AR in synchronization with the input of the address designating signal MC, and simultaneously, outputs a memory display signal MD for a predetermined time interval $T_1$.

Also, memory data DM is output as the first display data $D_1$ and calculated data ED is output as the second display data $D_2$, and "MEMO" is displayed. Namely the watch displays a condition as described in FIG. 17.

On the other hand, the address designating circuit 43 designates a memory content to be displayed upon the input of the memory display signal MD. Therefore, the address designating circuit 43 outputs an address signal AD which designates address No. 9 with an input of the address reset signal AR, and thus the content of the memory registered in address No. 9 of the memory circuit 42 is output therefrom as memory data DM.

In the calculating circuit 44, a calculation described below is carried out. Now, as shown in FIG. 16, a content of the data counter 41 is No. 32, and thus the 32nd data is the latest data. In this situation, when an address reset signal AR is output just after a memory display signal MD is output, an address designating signal AD designating the address No. 9 is output from the address designating circuit 43. Then, the calculation, $32-9=23$, for example, is carried out and the calculating circuit outputs the data 23 as calculated data ED. Next, when the address increment signal MC is output again from the external operation circuit block 110 before the predetermined time interval of the memory display timer 124 of the display switching circuit 40 is over, as explained in FIG. 13, the memory displaying timer 124 is reset and the address designating circuit 43 outputs an address signal AD designating an address No. 8 while decrementing the count number by 1, and thus the memory circuit 42 outputs the address No. 8 and the memory content registered in that address as a memo data DM, and simultaneously, a subtraction $32-8=24$, for example, is carried out in the calculation circuit 44 and a data "24" is output as a calculation data ED.

Accordingly, in the display condition of FIG. 17, the memory content in address No. 7 is displayed. As described above, in a stopping condition of a stop watch, when the elapsed time switch $S_2$ is turned ON, the MEMO is first displayed, and thereafter, when said split switch is turned ON before the predetermined time interval of the memory display timer 124 is ended, the address signals MC are output one by one, and thus the memory content registered in the memory circuit 42 is sequentially retrieved, from the oldest data to the latest data in the memory circuit.

The retrieved memory data DM and the calculated data ED correspond to the elapsed time measured at certain times during the measurement and the number of times the elapsed time was measured.

Generally speaking, in a ski race, since the skier is travelling at a high speed and carrying a stick in each hand, it is difficult and dangerous to attempt to operate a conventional stop watch. However, according to this invention as mentioned above, even when the skier stops the stop watch after a predetermined time has passed from the time the finishing line was reached, the data at the time the skier reached the line can be retained in this system, and thus the user can safely make an accurate time measurement. Further, according to the invention, when measuring an elapsed time with a stop watch a reset operation is not required every time a starting operation to measure the elapsed time is carried out, and each time measurement is automatically started from a reset condition caused by the starting operation. Moreover, according to the invention, the stop watch system comprises a memory circuit for storing a plurality of the elapsed times and a number of times the elapsed time was measured.

Therefore, in swimming, skiing or short distance foot races, for which, records are kept, the final elapsed time must be determined, rather than the split time i.e., intermediate time, and thus this invention provides a useful operation system in practice.

I claim:

1. A stop watch, comprising,
a reference signal generator circuit,
a stop watch circuit for counting reference signals generated by said reference signal generator circuit and developing elapsed time data,
an external operation switch circuit controlling the operation of said stop watch circuit,
a display means,
an elapsed time display timer circuit for controlling the stop watch circuit for giving said stop watch circuit commands to display a time measuring in said stop watch circuit continuously at said display means and to display an elapsed time at said display means for a selected time interval,
an impact detecting circuit for detecting an impact force loaded on an outer case of the watch and for developing an impact pulse signal by converting the impact force to an electrical signal,
wherein an elapsed time data in said stop watch circuit is displayed at the display means for a predetermined time interval by starting an operation of the elapsed time display timer circuit with an impact pulse signal generated from said impact detecting circuit when said impact detecting circuit detects a impact force caused by striking an outer case of the stop watch and is displayed fixedly at the display means as a final elapsed time by operating said external operation switch circuit while said elapsed time display timer is working.

2. A stop watch according to claim 1, wherein a stop watch circuit further comprises an elapsed time measuring circuit and a latch circuit.

3. A stop watch according to claim 2, wherein an elapsed time memory circuit and a display selecting circuit are provided for cooperating with said stop watch circuit.

4. A stop watch according to claim 2, wherein said elapsed time display timer circuit includes a latch timing signal generating circuit for generating a latch signal causing said latch circuit to read data measured in said elapsed time measuring circuit and for stopping the generation of said latch signal while said elapsed time display timer works.

5. A stop watch according to claim 1, 2, 3 or 4, wherein said external impact detecting circuit further comprises at least one piezoelectric element fixed to a portion of a case of the watch.

6. A stop watch according to claim 5, wherein said at least one piezoelectric element has a common electrode on one surface of a piezoelectric material and at least one corresponding electrode on the opposite surface thereof.

7. A stop watch according to claim 6, wherein at least two separated electrodes are provided on one surface of said piezoelectric material and a common electrode is provided on the opposite surface thereof.

8. A stop watch according to claim 7, wherein an electric signal generated on at least one electrode on at least one surface of said material of said piezoelectric element, is utilized as a controlling signal.

9. A stop watch according to claim 5 wherein a plurality of piezoelectric elements are provided.

10. A stop watch according to claim 7, wherein an electric signal generated at at least one electrode is utilized, as an impact detecting signal and at least one other electrode is used as an alarm generating element.

11. A stop watch according to claim 9, wherein an electric signal generated on at least one piezoelectric element is utilized as an impact detecting signal and at least one other piezoelectric element is used as an alarm generating element.

12. A stop watch according to claim 2, wherein said elapsed time measuring circuit is further provided with a plurality of memory circuits for memorizing only a final elapsed time measured when an impact force is loaded on a watch case, in said each memory, and for retrieving and displaying said data at said display means by an operation of said external operating switch circuit.

13. A stop watch according to claim 12, wherein said elapsed time measuring circuit is further provided with a data counter for counting a number of times said elapsed time is memorized.

14. A stop watch according to claim 1, 2, 3, 4 or 12 wherein a stop watch circuit starts to count a reference signal from an initial condition when a starting operation of said external operation switch circuit block is carried out.

15. A stop watch according to claim 12, wherein a reset signal for resetting said elapsed time measuring circuit is output from said memory circuit.

16. A stop watch, comprising,
a reference signal generator circuit,
a stop watch circuit for counting reference signals generated by said reference signal generator circuit and developing elapsed time data,
an external operation switch circuit controlling the operation of said stop watch circuit,
an elapsed time memory circuit for memorizing an elapsed time in said stop watch circuit,
a display selection circuit for selecting either data from said elapsed time memory circuit or data from said stop watch circuit for display by a display means,
an elapsed time display timer for controlling said display selection circuit and retaining a display of said elapsed time data for a predetermined time,
an impact detecting circuit for detecting an impact force loaded on an outer case of said watch and for generating an impact pulse signal by converting the impact force to an electrical signal,
wherein, said impact pulse generated by striking said case of said watch causes said elapsed time memory circuit to memorize elapsed time data in said stop watch circuit and simultaneously causes said elapsed time display timer to start operating to thereby cause said display selection circuit to convert a mode showing said data from said stop watch circuit into a mode showing data from said elapsed time memory circuit, further, an output pulse from said external operation switch circuit is applied to said display selection circuit when said converted mode is applied, causing said display selection circuit to control said display means so as to fixedly display said data memorized in said elapsed time memory circuit as a final measured elapsed time.

17. A stop watch comprising, a reference signal generator circuit, an elapsed time measuring circuit for counting reference signals generated by said reference signal generator circuit and for measuring an elapsed time, an external operation switch circuit for controlling the operation of said elapsed time measuring circuit, an impact detecting circuit for detecting an impact force loaded on an outer case of said watch and for controlling the operation of said elapsed time measuring circuit with a detected signal as an output thereof, a display timer circuit for displaying selected elapsed time data from those time data measured by an output signal of said impact detecting circuit and measured by an output signal of said external operation switch circuit, at said display means for a predetermined time interval, a plurality of memory circuits for memorizing an elapsed time data therein every time said measurement is carried out, a data counter for counting a number of times said measurement is carried out, wherein, said elapsed time data is fixedly displayed at said display means by making said display timer circuit operational in synchronization with an output signal of said impact detecting circuit, and further, while said display timer circuit is operating, memorizing only said elapsed time data recognized as a final data, in the plurality of memory circuits by a stopping operation on said external operation switch circuit and incrementing data in said data counter by one every time said elapsed time data is input to said memory circuit.

* * * * *